United States Patent [19]

von der Eltz et al.

[11] 3,990,845

[45] Nov. 9, 1976

[54] PROCESS FOR THE FIXATION OF DYESTUFFS

[75] Inventors: Hans-Ulrich von der Eltz; Richard Gross; Walter Birke; Albert Reuther, all of Frankfurt am Main, Germany

[73] Assignee: Hoechst Aktiengesellschaft, Frankfurt am Main, Germany

[22] Filed: Apr. 5, 1974

[21] Appl. No.: 458,429

Related U.S. Application Data

[63] Continuation of Ser. No. 183,626, Sept. 24, 1971, abandoned, which is a continuation of Ser. No. 682,821, Nov. 14, 1967, abandoned.

[30] Foreign Application Priority Data

| | | |
|---|---|---|
| Nov. 16, 1966 | Germany | 50694 |
| Apr. 11, 1967 | Germany | 52090 |
| Apr. 15, 1967 | Germany | 52132 |

[52] U.S. Cl. ..... 8/149.3

[51] Int. Cl.[2] ..... D06B 5/18

[58] Field of Search..... 8/149.1, 149.2, 149.3, 8/150, 154, 155, 155.1, 155.2; 68/5 R, 5 A, 5 B, 5 C, 5 D, 5 E, 7, 8

[56] References Cited

UNITED STATES PATENTS

| | | | |
|---|---|---|---|
| 473,398 | 4/1892 | Kirk et al. | 68/7 |
| 1,786,421 | 12/1930 | Buhlmann | 68/8 X |
| 2,446,502 | 8/1948 | Wehrli | 8/149.1 |
| 2,951,356 | 9/1960 | Mellbin | 68/8 |
| 3,396,415 | 8/1968 | Meier-Windhorst | 68/5 E X |
| 3,477,073 | 11/1969 | Blount et al. | 8/149.1 |

*Primary Examiner*—Philip R. Coe
*Attorney, Agent, or Firm*—Curtis, Morris & Safford

[57] ABSTRACT

Process for the fixation of dyestuffs on textile materials of synthetic, regenerated or native fibers or of mixtures thereof, in which the textile material treated with a dyestuff preparation is introduced into a chamber and it is dwelled there, batched or cuttled up under pressure-steam.

1 Claim, 1 Drawing Figure

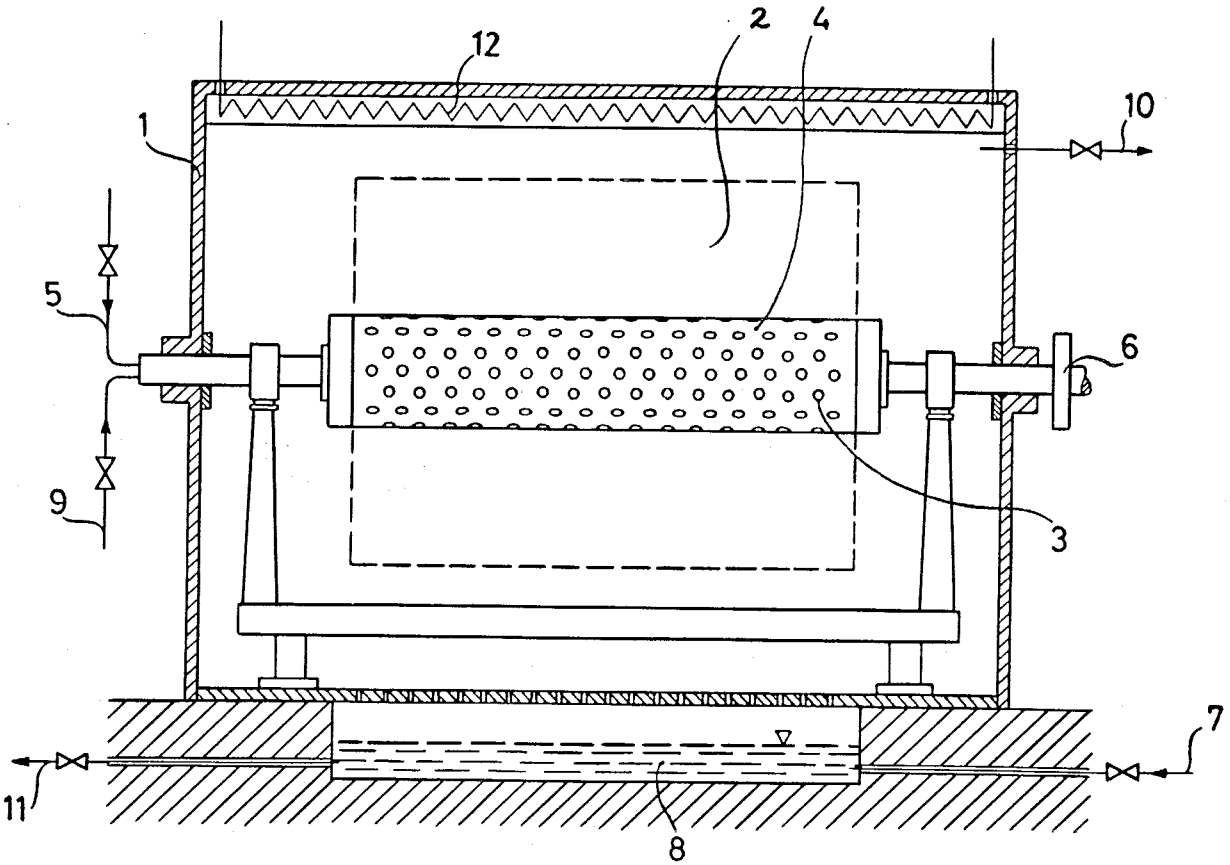
INVENTOR
BY

PROCESS FOR THE FIXATION OF DYESTUFFS

This application is a continuation of copending application Ser. No. 183,626, filed Sept. 24, 1971, which application was in turn a continuation of application Ser. No. 682,821, filed Nov. 14, 1967, both now abandoned.

It is known that dyestuffs can be fixed on textile materials of synthetic, regenerated and native fibers by submitting the material provided with the dyestuffs to steam of about 0.5 to 2 atmospheres excess pressure (gauges). For this treatment pressure chambers (for example star steamers) are used in which the textile material impregnated with the dyestuff solution or the dyestuff dispersion is suspended or fixed with pins and, when the chamber is closed, the desired pressure is adjusted by blowing in steam. Fixation may also be effected in so-called continuous pressure-steamers where the material impregnated with the dyestuff is continuously passed through the steamer under pressure.

However, both methods of pressure-steaming are of considerable disadvantage. Thus, discontinuous steaming in a chamber implies an important loss of time due to the suspending or fastening by pins of the material and to the subsequent blowing in of steam, and, moreover, only small to medium sized batches can be dyed. Because of these negative facts the above method is not economic. In a similar way also the use of continuous pressure-steamers especially in the dyeing of synthetic fibers is attended with economic detriment. The continuous pressure-steamers are furnished with a capacity of goods in general of about 60 meters of material. When a dwelling-time of 2 minutes with steam of 1.8 atmospheres excess pressure (gauge) has to be observed, as it is necessary under optimal conditions for the dyeing of polyester fibers with dispersion dyestuffs in order to obtain a good colour yield, working time for dyeing a textile material having a length of for example 3,600 meters requires 2 hours. This shows that the production speed of the known process is relatively low.

The step following the steaming process is in general an aftertreatment requiring once more a separate apparatus and which can be incorporated continuously in the steaming process only when applying the continuous pressure-steaming.

The machinery used for the conventional pressure-steaming processes thus comprises the steamer and the aftertreatment plant, necessitating much space for the aftertreatment plant especially when it is a continuously working apparatus (for example a full width washing machine).

Now an essentially more economic and, as to the mechanical equipment, a more space-saving process has been found for the fixation of dyestuffs on textile materials of synthetic, regenerated or native fibers or of mixtures thereof by means of pressure-steaming, when introducing the textile material treated with a dyestuff preparation into a chamber and dwelling it there batched or cuttled up under steam of 0.5 to 5.0 atmospheres excess pressure gauge. It is, however, expedient to use steam in the range of from 1.0 to 3.0 atmospheres excess pressure (gauge). The pressure of the steam applied which has to be observed in each individual case depends above all on the dyestuff used, on the quantity of dyestuff and on the textile material used.

For the fixation of dyestuffs on synthetic fibers generally higher pressures of the steam applied are necessary, steam of 1.7 to 2.5 atmospheres excess pressure (gauge) being especially advantageous when using polyester fibers.

The time during which textile material impregnated with the dyestuff is allowed to dwell in the chamber under the corresponding pressure amounts to 0.5 to 60 minutes according to the nature of the dyestuff, the depth of colour desired and the kind of the textile material; normally 1 to 30 minutes are sufficient, but more than 20 minutes are rarely necessary. Synthetic fibers, again, have to be longer exposed to pressure-steaming.

Compared with the conventional methods for the fixation of dyestuffs by pressure-steaming, the process of the present invention enables an essential acceleration of the production speed. When padding, for instance, a fabric of polyester fibers having a length of 3,600 meters at a speed of 80 meters per minute with a liquor containing per liter of water the necessary quantity of a dispersion dyestuff for achieving a dark blue shade, then rolling the padded fabric at the constant speed continuously onto the roller in the chamber, and putting the closed chamber under 2 atmospheres excess pressure (gauge) by means of steam, the dyeing — disregarding the aftertreatment — is finished within 95 minutes after a heating up of the steamer of 30 minutes and a dwelling time of the padded material in the chamber of 20 minutes. Compared with the same dyeing produced with the aid of a continuous pressure-steamer the process of the present invention shortens the working time by 25 minutes or about 21 percent, not regarding the time for heating up the continuous pressure-steamer.

It is a great surprise that even with a highly charged roller a thorough and equal fixation of the dyestuffs is obtained within the mentioned short times of dwell in the steam chamber.

In the process of the present invention the textile material is batched or cuttled up for steaming after the padding with the dyebath. The material may be batched or cuttled up in the interior of the chamber or out of the chamber. When batching or cuttling up in the chamber being under pressure by means of steam the inlet of the chamber has to be tightened with an appropriate device, for example with a pair of rollers. When the material has dwelled long enough in the chamber it may be removed by letting off the steam and by opening the chamber or by reversed running of the driving arrangements.

It is also possible to wind up the padded textile material on a roller and thus to introduce it into a chamber which is connected over a shaft with a second chamber. Subsequently, the first chamber is closed and filled up with cold pressure-gas (preferably compressed air) whereas the second chamber is supplied with steam under pressure. The textile material is then drawn from the first chamber by means of a forerunner into the second chamber in order to be fixed.

Likewise favourable results are obtained with the process of the present invention by sewing the textile material to be dyed on a forerunner which is led through the pressure-steamer, then padding it with the dyestuff solution or dyestuff dispersion, introducing it continuously into the chamber filled with steam under pressure by means of a pressure-tight inlet-device, generally a pair of rollers, and there cuttling it up by means of a corresponding arrangement, for example a slide.

When the dwelling-time necessary for the fixation of the dyestuff is over the outlet device is put into action, in general also a pair of rollers, and the material is removed from the steamer. As long as the outlet speed does not exceed the inlet speed new material can be introduced into the chamber without reducing the time of dwell. The material thus treated is then, as usual, cuttled up, batched up or directly led into a full width washing machine for aftertreatment. A preferred form of the process of the invention is to remove the material from the pressure-steamer at the same speed as unsteamed material is led into the chamber.

A suitable and advantageous simplification of the fixation process of the present invention is to roll up the material treated with the dyestuff preparation on a perforated roller and, in a special device, to expose it successively to the pressure-steaming and the aftertreatment. The apparatus used, as shown in the sole FIGURE, consists mainly of a pressure chamber 1 which can be practically hermetically closed, in which a hollow roller 4 is installed in horizontal line as supporter for the batched up material 2. While the mantle of the roller is perforated 3 through which liquids are pressed coming from the interior of the roller, the front ends of the roller are tight and are combined with pipes supplying liquids 5 by connecting pipe sockets. With these feed pipes the liquors for the aftertreatment are brought to the material on the roller. The roller is movable round its axis and can rotate for example by means of a motor 6. The diameter of the roller may be adapted to the conditions and technical requirements of each individual case, in general the diameter is chosen within the range of from about 10 cm to about 50 cm, but it is also possible to use bigger rollers, for example with a diameter of about 70 cm. The width of the roller depends on the textile material to be treated and amounts in most cases to between about 90 cm and 200 cm. The perforation of the roller with which the material comes into contact is suitable finely porous; the distance between the pores is in general not more than 30 mm, preferably less than 15 mm, the diameter of the pores is about 5 to 30 mm. The chamber can be put under pressure by steam which is led through corresponding feed pipes 7 and which is, if desired, pressed through a swamp 8 on the bottom of the chamber. The bottom of the apparatus is provided with an outlet tap 11. If the appropriate pipes 9 are installed it is also possible to press the steam through the perforated roller and thus through the textile material into the chamber. The pressure chamber may be provided with a special vacuum device 10 which allows to produce a diminished pressure in the chamber. For the preparation of overheated pressure-steam there may be eventually built in appropriate heating installations 12, for example electrically heated coils or other heating elements which are preferably installed as ceiling heating in order to avoid the formation of condensed water. An example of a machine used for the fixation and aftertreatment in the process of the present invention is given by the attached drawing in diagrammatic section.

When applying this preferred variant of the process of the present invention in using the above described machine, the textile material impregnated with the dyestuff solution or the dyestuff dispersion may be rolled up on the roller in the steaming chamber or out of the chamber. When the roller is in the chamber the chamber is closed, filled with steam under pressure and the material batched up on the roller is exposed to the action of the pressure-steam atmosphere until fixation of the dyestuffs terminated.

The steam in the chamber may be additionally heated for example by means of the electric heating so that overheated steam instead of saturated steam is in the chamber.

When the dwelling time is over the pressure is released and the liquors, necessary for the aftertreatment, are pressed through the perforation of the roller and the textile material. It is also possible to rotate the roller during the aftertreatment whereby the centrifugal forces thus produced promote the flow of the aftertreatment baths through the perforation and the material in contact with the roller. The speed of rotation of the roller is in this case adjusted according to the density of the textile material and the size of the batch. In general, 50 to 500 rotations of the roller per minute are applied, in most cases 300 to 400 times per minute are sufficient. The flow of the liquors through the textile material packed on the roller can be additionally facilitated by producing for the time of the aftertreatment a diminished pressure in the chamber by means of appropriate vacuum devices. The partial vacuum which may be applied is 100 to 600 mm of mercury, in general 250 to 450 mm of mercury. A specially quick and/or good purification effect is obtained when combining both methods, the rotating of the roller and the producing of an external vacuum. With the aid of appropriate collecting vessels the different aftertreatment baths can be collected and again led back to the textile material.

The process of the present invention is not only suitable for the fixation of dyeings but also for the fixation of printing on textile materials. In this event the printing pastes are applied to the material in known manner, then the printed material is dried and thereupon rolled onto the roller, and subsequently subjected to the fixation according to the method of the present invention and finished. With dyeings an intermediate drying step is also possible, in general, however, not necessary.

For the fixation of dyestuffs according to the present invention the textile material may be present in different stages of manufacture, in most cases in form of fabrics, knitted fabrics, moreover in form of hanks, combed material or cables. Especially appropriate are fibrous materials of synthetic origin, such, for example as high molecular polyesters, polyamides or polyacrylonitriles. But it is also advantageous to use textile materials of regenerated cellulose, such for example as spun rayon, or native fibers, such as cotton, wool, silk or linen. Frequently are used mixed materials of the synthetic fibers one among another or together with natural or regenerated fibers, such as polyester and cellulose fibers or polyester fibers and wool.

In the present process there may be used in principle all dyestuffs which can be fixed on the materials used under the action of heat. Such dyestuffs are well known and their choice depends in the first place on the nature of textile material applied. Thus, for example, for the dyeing and printing of polyester fibers dispersion dyestuffs are used, whereas for polyamide fibers acid dyes, complex metallic dyes or dispersion dyes are used. As dispersion dyestuffs are to be understood those of the series of the azo or anthraquinone dyes, among which the azo dyes may or may not be metallized. For the preparation of dyeings or prints on cellulose fibers there may be used for example the known direct dyestuffs or reactive dyestuffs, the latter with the addition of alkalies. When dyeing in a single bath mixed fabrics of polyester/cellulose fibers, leuco-ester of vat dyestuffs are especially appropriate. When using these dyestuffs it is of advantage to add in addition to an acid donator especially sodium nitrite. In this case both types of fibers are level dyed. Besides these dyestuffs there may also be used for the single bath dyeing or for the printing of polyester/cellulose fiber mixtures padding liquors or printing pastes which contain in addition to dispersion dyestuffs direct dyestuffs or reactive dyestuffs and alkalies. The enumeration given above serves to illustrate the invention but not to limit it thereto.

In the process of the present invention the usual auxiliaries, such as electrolytes, dispersing, levelling or wetting agents, carriers or thickening agents, may be added to the padding liquors or printing pastes.

As aftertreatment baths there are used in the process of the present invention the same rinsing, acidifying, soaping and reducing baths as are usually applied for the dyeing of the corresponding textile materials with the corresponding dyestuff categories.

The following Examples serve to illustrate the invention but they are not intended to limit it thereto.

EXAMPLE 1

A mixed fabric of polyethylene terephthalate fibers and spun rayon with a mixing ratio of 70:30 is padded on the foulard at a speed of 70 meters per minute and a squeezing effect of 60 percent per weight, with an aqueous liquor containing per liter 30 g of the dispersion dyestuff of the formula

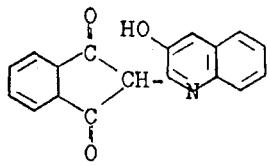

in commercial form and condition and 0.5 cc of a 60 percent acetic acid.

The padded fabric is batched up onto a roller and is brought into a chamber which is connected with a second chamber by a shaft. The padded textile material on the roller in the first chamber is fastened on an empty roller in the second chamber by means of a forerunner.

The first chamber is adjusted by means of compressed air and the second chamber by means of steam to 3 atmospheres excess pressure gauge and the textile material is then drawn into the second chamber heated with steam. After a dwelling-time of 20 minutes the pressure is let off and the roller is removed from the second chamber. The textile material is then rinsed and treated as usual. A yellow dyeing is obtained as it is likewise obtained according to the continuous pressure-steaming process which requires, however, an essentially longer time of production.

EXAMPLE 2

A mixed fabric of polyethylene terephthalate fibers and spun rayon with a mixing ratio of 70:30 is padded on the foulard at a speed of 70 meters per minute and a squeezing effect of 60 percent by weight, with an aqueous liquor containing per liter 60 g of the dispersion dyestuff of the formula

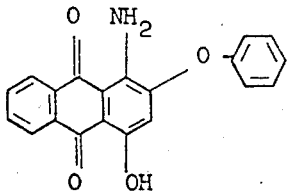

in commercial form and condition and 0.5 cc of a 60 percent acetic acid.

The padded fabric is wound up on a roller and given into a chamber which is connected over a shaft capable of being closed with a second chamber heated with steam to 1.5 atmospheres excess pressure gauge. The padded textile material on the roller in the first chamber is then fastened on an empty roller in the second chamber by means of a forerunner.

Then the first chamber is adjusted by means of compressed air to 1.5 atmospheres excess pressure gauge, the connecting shaft to the second chamber is opened and the textile material is drawn into the second chamber which is heated with steam.

The connecting shaft to the first chamber is closed and the textile material is allowed to dwell for 40 minutes in the steam chamber. After opening the connecting shaft the textile material is drawn back into the first chamber by reversed running of the driving arrangement. The material is then rinsed and treated as usual. A full red dyeing is obtained.

EXAMPLE 3

A mixed fabric of polyethylene terephthalate fibers and spun rayon with the mixing ratio of 60:30 is padded on the foulard at a speed of 80 meters per minute and a squeezing effect of 50 percent per weight, with a liquor containing per liter of water 80 g of the dispersion dyestuff of the formula

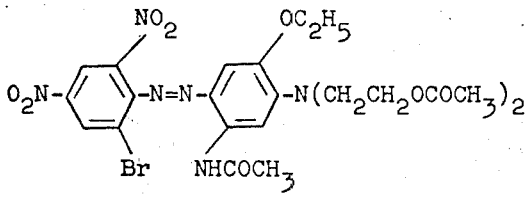

in commercial form and condition, the bath being adjusted to pH 4.5 by means of acetic acid.

The padded material is then dried for 2 minutes at 130° C and wound up onto a roller. The roller is given into a chamber which is tightly closed and fed with steam of 2.5 atmospheres excess pressure gauge. The textile material is allowed to dwell at this pressure for 20 minutes, then the pressure is released and the roller is put out of the chamber. Thereupon the material is rinsed and treated as usual.

A navy blue dyeing is obtained as is also obtained according to the continuous pressure-steaming process, however, at an essentially longer production time.

EXAMPLE 4

A knitted fabric made of polyamide fibers is padded on the foulard at a speed of 50 meters per minute and a squeezing effect of 40 percent by weight with a liquor containing per liter of water 20 g of the dyestuff of the formula

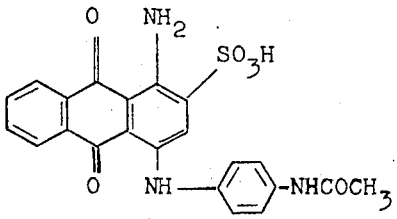

Steaming under pressure is effected in the chamber given in Example 1, with steam of 1.2 atmospheres excess pressure gauge. The padded fabric is allowed to dwell for 10 minutes.

A blue dyeing is obtained.

EXAMPLE 5

A mixed fabric of polyethylene terephthalate fibers and spun rayon with a mixing ratio of 67:33 is padded on the foulard at a speed of 50 meters per minute and a squeezing effect of 55 percent by weight, with an aqueous liquor containing per liter 60 g of the dispersion dyestuff of the formula

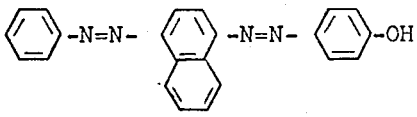

in commercial form and condition, the bath being adjusted to ph 5.5 by means of acetic acid.

The padded fabric sewed on to a forerunner is continuously led at a speed of 50 meters per minute into a chamber supplied with steam of 132° C and of 2.0 atmospheres excess pressure gauge, the chamber being closed by two pairs of rollers. By the front rollers the textile material is introduced into the chamber and cuttled up on a slide. During the feeding of the material the second pair of rollers, which serve as outlet, is not in action. After a dwelling time of 6 minutes the outlet rollers are put into action which convey the material at a speed of 50 meters per minute out of the steamer. The material is then rinsed and aftertreated as usual.

On the polyester portion of the material a deep orange shade is obtained.

When effecting the dyeing according to the continuous pressure-steaming process an essentially longer production time is required in order to yield the same depth of colour.

EXAMPLE 6

A mixed fabric of polyethylene terephthalate fibers and spun rayon with a mixing ratio of 70:30 is padded on the foulard at a speed of 75 meters per minute and a squeezing effect of 60 percent by weight, with an aqueous liquor containing per liter 30 g of the dispersion dyestuff of the formula

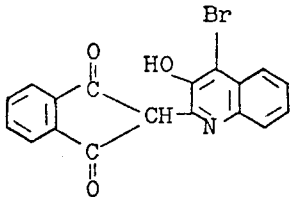

in commercial form and condition, the bath being adjusted to pH 5 by means of acetic acid.

The padded fabric is continuously introduced over a roller closure into a pressure-steamer containing saturated steam of 1.8 atmospheres excess pressure gauge.

In the steamer the fabric is cuttled up on a slide. After a dwelling-time of 6 minutes the pair of rollers serving as outlet device is put into action and the material is removed from the steamer at a speed of 75 meters per minute. When all material has left the steamer it is aftertreated as usual. A yellow dyeing at a very good yield of colour is obtained.

EXAMPLE 7

A mixed fabric of polyethylene terephthalate fibers and cotton fibers with a mixing ratio of 67:33 is padded on a foulard at a speed of 75 meters per minute and a squeezing effect of 60 percent by weight, with an aqueous liquor containing per liter 60 g of the dispersion dyestuff of the formula

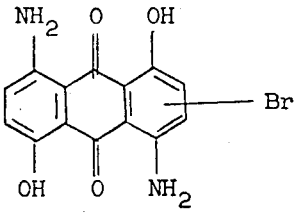

in commercial form and condition, the bath being adjusted to pH 5.5 by means of acetic acid.

Steaming under pressure of the padded material is effected as described in Example 6. A dark blue dyeing of a very good yield of colour is obtained.

EXAMPLE 8

A knitted polyamide fabric is padded on a foulard at a speed of 50 meters per minute and a squeezing effect of 40 percent by weight with an aqueous liquor containing per liter 10 g of the dyestuff of the formula

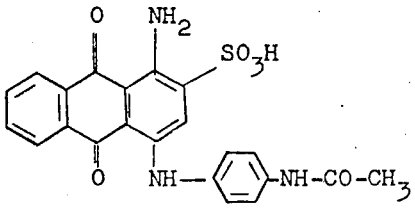

in commercial form and condition. The padded knitted fabric is drawn through an infrared heating shaft and then it is continuously conveyed by means of a pair of rollers into a pressure-steamer and cuttled up there on a slide. The steamer is supplied with steam of 1.4 atmospheres excess pressure (gauge). After 6 minutes the rollers serving as outlet are put into action and the knitted fabric is removed from the pressure-steamer at a speed of 50 meters per minute. The fabric is then aftertreated as usual. A blue dyeing of a good yield of colour is obtained.

EXAMPLE 9

A mixed fabric of linear polyester and cotton fibers with a mixing ratio of 67:33 is padded on the foulard at a squeezing effect of 60 percent by weight with an aqueous liquor containing per liter 5 g of the dyestuff having the Colour-Index No. 73,671, 5 g of ammonium oxalate, 5 g of sodium nitrite and 2 g of the condensation product of 9 moles of ethylene oxide and 1 mol of nonyl phenol. The padded fabric is cuttled up and put into a chamber and there it is then steamed at 2.5 atmospheres excess pressure gauge for 15 minutes. Thereupon the material is aftertreated as usual. A mixed fabric is obtained, the polyester and cotton portion of which is dyed in a grey shade.

EXAMPLE 10

A mixed fabric of linear polyester and cotton fibers with the mixing ratio of 67:33 is padded on the foulard at a squeezing effect of 60 percent by weight with an aqueous liquor containing per liter 10 g of the dyestuff having the Colour-Index No. 59,826, 10 g of ammonium formiate, 5 g of sodium chlorate and 2 g of the condensation product of 9 moles of ethylene oxide and 1 mole of nonyl phenol. The padded fabric is rolled up on a roller which is then brought into a chamber connected over a shaft with a second chamber. The padded textile material on the roller in the first chamber is fastened by means of an intermediary forerunner onto an empty roller in the second chamber.

The first chamber is adjusted by means of compressed air, the second by means of steam to 2.5 atmospheres excess pressure gauge and the material is then drawn into the second chamber heated by steam. After a dwelling time of 10 minutes the pressure is released and the roller is removed from the second chamber. Subsequently, the material is rinsed and aftertreated as usual. A mixed fabric is obtained, the polyester and spun rayon portion of which is dyed in a green shade.

When using in the above-given Example instead of the dyestuff having the Colour-Index No. 59,826 the equivalent amount of the dyestuff with the Colour-Index No. 73,356 or No. 73,336 a respectively scarlet or orange dyeing is obtained.

We claim:

1. In a process for a fixation of a dyestuff on a textile material of synthetic, regenerated or natural fibers or of mixtures thereof by means of pressure-steaming, the improvement of which comprises: introducing said textile material treated with a dyestuff preparation into a steam-pressurized zone in an unwound state, winding up said textile material in said zone, continuing to expose for 1 to 30 minutes said textile material to steam while in a wound up condition without rotation of same, said steam being at an excess pressure from 1.0 to 3.0 atmospheres gauge.

* * * * *